United States Patent [19]

Snyder

[11] 4,042,187

[45] Aug. 16, 1977

[54] REELED WIRE HOLDER

[76] Inventor: Gene J. Snyder, 3820 Pontiac Lake Road, Waterford, Mich. 48095

[21] Appl. No.: 609,384

[22] Filed: Sept. 2, 1975

[51] Int. Cl.[2] ..... B65H 17/46

[52] U.S. Cl. ..... 242/86.5 R

[58] Field of Search ..... 242/85, 115, 86.5 R, 242/129, 128, 86.52, 86.2; 254/166

[56] References Cited

U.S. PATENT DOCUMENTS

| | | | |
|---|---|---|---|
| 1,054,919 | 3/1913 | Hoard | 242/86.5 R |
| 2,393,655 | 1/1946 | Robeck | 242/86.52 X |
| 2,616,636 | 11/1952 | Ades | 242/86.5 R |
| 3,913,854 | 10/1975 | McClure | 242/86.52 X |

*Primary Examiner*—Edward J. McCarthy
*Attorney, Agent, or Firm*—Arnold S. Weintraub

[57] ABSTRACT

Apparatus for facilitating the unreeling of wire from cartons or spools thereof includes a vehicle mounted support stand and insertable wire receiving members therefor. A first member includes rotatable legs which seat a carton of wire thereon. A second member receives at least one spool of wire. The support stand is detachably mounted to the vehicle and may be removed therefrom.

10 Claims, 5 Drawing Figures

REELED WIRE HOLDER

BACKGROUND OF THE INVENTION

1. Field of the Invention

The present invention pertains to wire holders. More particularly, the present invention pertains to wire holders for facilitating the unreeling of wires and cables. Even more particularly, the present invention concerns supports and support stands for facilitating the unreeling of wires and cables.

2. Prior Art

As is known to those skilled in the art to which the invention pertains, one of the more cumbersome aspects of building construction resides in the electrical wiring thereof. Electric wire and cable is conventionally contained and coiled within a carton. To utilize the wire it is necessary to uncoil and remove it from the carton. This is a tedious chore and quite often results in the cable coiling around itself. This same problem is encountered with small spools of wire, such as telephone wires and the like. Compounding the problems alluded to herein is the fact that the containers for the wire or cable generally sit on the floor of the construction site, thereby creating a safety hazard.

The prior art has sought some salient solutions to the problems identified hereinbefore. For example, U.S. Pat. No. 325,394 teaches a wire holding reel comprising three radially movable arms having catches formed therewith. The arms are inserted into the center of the coil and the arms are, then, spread out to engage the coil. The catches retain the coil to permit the uniform unreeling thereof.

U.S. Pat. No. 2,985,404 teaches a spindle for mounting a carton of coiled wire thereof. The device includes three radical fins which are fixed in position. In deploying the device, the carton is placed on the spindle and rested on a platform. The patent further teaches that as the wire is drawn out of the carton, it coils around the fins. The tensioning caused by the coiling around the fins provides traction on a capstan which rotates the platform and the carton.

U.S. Pat. No. 3,837,597 teaches a holder for a two hundred and fifty foot roll of cable. The device comprises a table which is rotatably secured to a post. As wire is needed it is unreeled from the table.

U.S. Pat. No. 3,858,849 teaches apparatus for feeding wiring conduit into a building wherein wire is fed from a spool mounted on a rod.

None of the prior art, however, affords the advantages accruing to the present invention, and which will be more fully detailed subsequently.

SUMMARY OF THE INVENTION

The present invention provides a wire reel holder which is adapted to accommodate both spools and cartons of wire. The device hereof includes a detachably mountable support stand. The support stand is adapted to be detachably mounted to a vehicle bumper. The support stand removably receives a cable mounting means. The cable mounting means supports a coil of cable thereon. The support stand, also, receives a spool mounting means.

The cable mounting means generally comprises a plurality of fixed fins about which the coil of cables is mounted and rotatable arms which are extended to define a platform to retain the coil thereon.

The spool mounting means comprises a housing which receives a horizontally extending elongated rod element. A spool of wire is mounted onto the rod element.

The support stand further comprises sockets which receive support legs. The legs permit the usage of the stand at the job site.

For a more complete understanding of the present invention reference is made to the following detailed description and accompanying drawing. In the drawing like reference characters refer to like parts throughout the several views, in which:

DETAILED DESCRIPTION OF THE PREFERRED EMBODIMENTS

Figure 1:
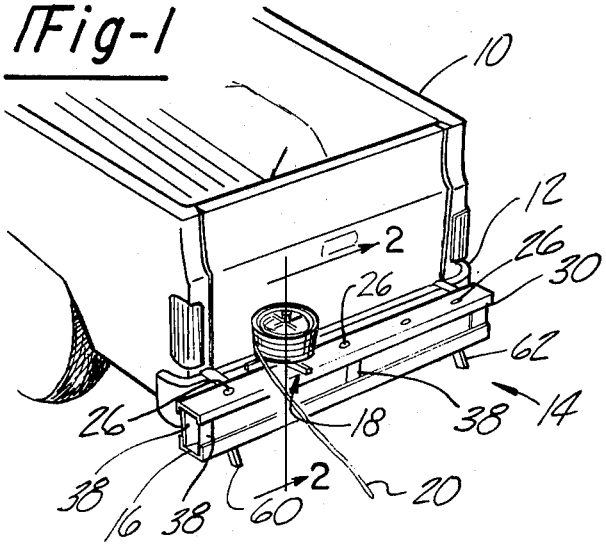
FIG. 1 is a perspective view of the rear of a vehicle having the reeled wire holder of the present invention mounted thereon.

Now, with reference to the drawing, and in particular FIG. 1, there is depicted therein a vehicle 10 having a rear bumper 12. Detachably mounted to the bumper 12 is the reeled wire holder of the present invention and which is generally denoted at 14. The reeled wire holder 14 generally comprises a support stand 16 and means, generally indicated at 18, for mounting a coil of wire 20 thereonto.

Figure 2:
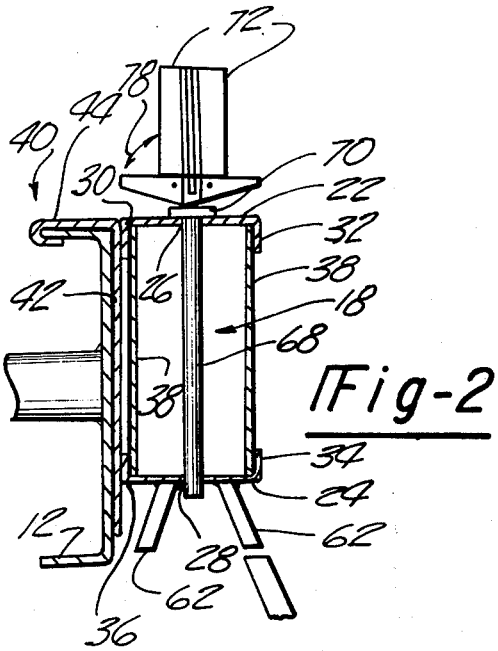
FIG. 2 is a cross-sectional view taken along the line 2—2 of FIG. 1.
Figure 5:
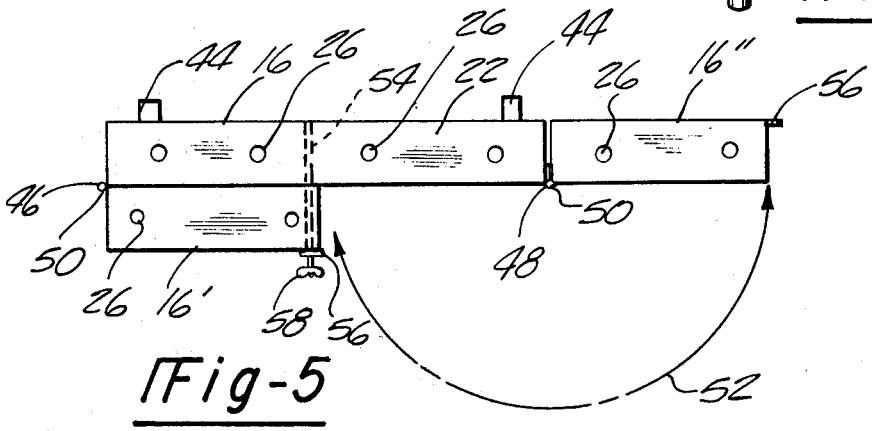
FIG. 5 is a top plan view of the support stand of the present invention.

With more particularity, and with reference to FIGS. 1, 2 and 5, the support stand 16 comprises a pair of parallel axially spaced apart top and bottom walls 22, 24, respectively. Each of the walls 22, 24 is provided with a plurality of central apertures 26 and 28, respectively. The apertures 26, 28 are formed such that one aperture 26 is in registry with one aperture 28 along the extent of the top and bottom walls. The top wall 22 includes a pair of opposite downwardly directed flanges 30, 32. The bottom wall 24 has a pair of opposite upwardly directed flanges 34, 36. It is thus seen that the flanges cooperate to provide opposed pairs of flanges 30, 34 and 32, 36.

The support stand 16 further includes a plurality of spacer elements 38. The spacer elements reinforce the support stand and provide structural integrity thereto. The spacer elements 38 are disposed along the extent of the support stand and extend between the top and bottom walls. As shown in the drawing, the spacer elements 38 are disposed interiorly of the flanges. The spacer elements 38 are secured to the interior surfaces of the opposed pair of flanges 30, 34 or 32, 36 by any suitable mode, such as welding or the like.

Figure 3:
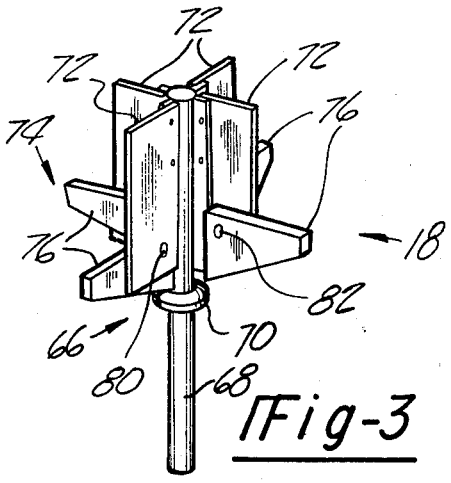
FIG. 3 is a perspective view of the cable mounting means of the present invention.

As clearly shown in FIGS. 2 and 3, secured to the outer surface of the opposed flanges 32, 36 is a means 40 for detachably mounting the support stand 16 to the bumper 12 of the vehicle 10. The means 40 comprises a plate 42 which is welded or otherwise secured to the opposed flanges. The plate 42 includes a hook portion 44. The hook portion 44 is configured to the shape of the bumper such that it is coincident therewith. In this manner the hook portion overlies and detachably securely hooks on to the bumper. It is apparent that other modes of rendering the support stand detachably mountable to the bumper will work with equal efficacy herein.

Referring again to the drawing, and in particular FIG. 5, a pair of hinges 46, 48 are secured to the exterior corners of the top wall 22. Although not shown in the drawing, the bottom wall also has a pair of hinges secured to the exterior corners thereof. The hinge 46 is registry with the hinge on the bottom wall and likewise the hinge 48 registers with the other hinge on the bottom wall. The registering hinges receive a hinge pin 50 therethrough.

The hinges function to hingedly connect a pair of opposite auxiliary support stands 16' and 16'' to the support stand 16. The auxiliary support stands rotate about their respective hinges in the direction of the arrow 52. The auxiliary support stands are constructed in the same manner as the support stand, absent the means 40 for detachably mounting the support stand to the bumper. Each auxiliary support stand has a length equal to about one-half the length of the support stand 16. It is to be appreciated that the auxiliary support stands 16',16'' are each detachably connected to the support stand 16 via the hinge pin. By removing the pins 50, the auxiliary support stands are quickly detached from the support stand.

In transporting the present holder 14, where the auxiliary support stands are connected to the support stand they are rotated about their respective hinge pins to lie within the extent of the support stand. An elongated threaded fastener 54, extends through the flanges 30, 32 and one of the top wall pairs of flanges of one of the auxiliary support stands. In the drawing, the fastener extends through the top wall flanges of auxiliary support stand 16'. An apertured plate 56, secured to the top wall flange of the other auxiliary support stand receives the fastener therethrough. A wing-nut or the like 58 secures the closing between the auxiliary support stands and the support stand. By effecting the closing and interconnection between the auxiliary support stands and the support stand, the length of the assembly is no greater than the length of the support stand, proper, which in turn, is no greater than the width of the transporting vehicle. This obviates any potential traffic hazard.

It is to be understood that the following discussion applies equally to the support stand and the auxiliary support stands.

Referring, again, to FIGS. 1 and 2, secured to the bottom wall 24 of the support stand 16 are pairs of angularly inclined sockets 60, 62, respectively. The sockets are, preferably, internally threaded. Each socket receives a leg 62 (only one of which is shown). Preferably, one end of each leg is threaded, such that each leg is threadably received by the associated socket. By providing the legs 64, the support stand can be stood on a ground surface at a work site. This is especially important when carrying out electrical wiring within the interior of a construction site. When doing exterior work or work close to the vehicle, the support stand can remain stationary on the vehicle.

As hereinbefore noted the present reeled wire holder 14, also, comprises means 18 for mounting a reel or coil of wire 20 thereonto. At the outset it should be noted that the terms "wire" and "cable" are synonymous. Furthermore, the terms wire and cable can include corrugated flexible tubing and the like. Thus, the present invention is adapted to facilitate the deployment of coiled or reeled products of the type herein defined. However, for purposes of clarity the following description will be made with reference to wire.

As is known to those skilled in the art to which the invention pertains, heavy electrical wire is normally sold in cardboard cartons and the like, rather than on spools. Thus, the present invention provides a first means 18 for mounting a carton of wire or the like.

Referring, specifically, to FIGS. 2 and 3, the means 18 comprises a spindle 66. The spindle 66 includes an elongated central post 68. The post 68 is insertable between pairs of registering apertures 26, 28, to mount the spindle onto the support stand or an auxiliary support stand, as shown. A medially disposed washer 70 is mounted on the post 68. The washer 70 defines a stop for inserting the post as well as providing a bearing surface to facilitate rotation of the spindle.

Radially extending outwardly from the post 68 above the washer 70 are a plurality of stationary fins 72. The fins 72 are secured to the post by any suitable mode, such as welding and the like. The fins retain the substantially circular shape of a coil of wire 20 placed thereon. Where the wire is contained in a carton, the carton has a central hole cut therethrough and the carton is mounted onto the spindle by inserting the fins through the central hole of the carton.

In order to support the carton or the coil a platform 74 is provided. The platform 74 is defined by a plurality of radially extending arms 76 each one being interposed between adjacent fins. The arms 76 are rotatable between an upright and horizontal position, as indicated by the arrow 78. The arms 76 are rendered rotatable via a plurality of pivot pins 80. The pins 80 extend between adjacent fins 74 through an aperture 82 formed in each arm 76. A stop (not shown) extending from the post limits the rotation of each arm. The arms are rotated to the horizontal position prior to mounting the wire on the spindle. It is seen from the preceding that when a coil or carton of wire is mounted on the spindle, the circularity thereof is maintained by the fins. Likewise, the coil or carton will seat on the platform, as defined by the arms. The wire is then unreeled by pulling the end thereof. As the coil is unreeled it will tend to rotate, which in turn, causes the spindle to rotate therewith, thereby obviating any tendency for the coil to wrap around itself and become entangled.

Figure 4:
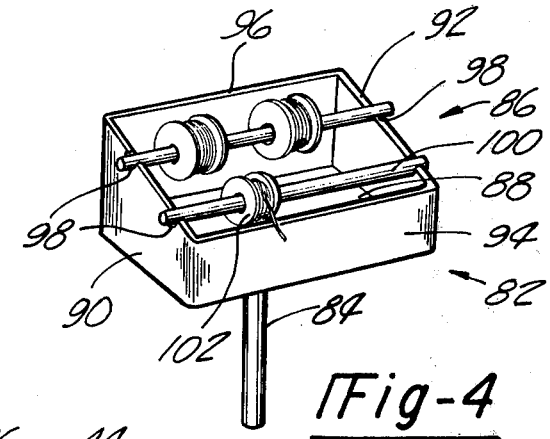
FIG. 4 is a perspective view of the spool mounting means of the present invention.

As hereinbefore noted, the present invention also comprises means for facilitating the unreeling of spools of wire. Referring now to FIG. 4 there is depicted therein a means 82 for facilitating the unreeling of spools of wire, such as telephone wire and the like. The means 82 comprises a central post 84 which is insertable into a pair of registering apertures 26, 28 in the same manner as described hereinbefore. Seated atop the post 84 is an open-topped housing 86. The housing includes a bottom wall 88 which seats on the top wall of the support stand or auxiliary support stand upon insertion, of the post through a pair of registering apertures. The housing, also, includes a pair of upstanding parallel, spaced apart side walls 90,92. The top edges of the side walls are provided with a downwardly sloping incline, as shown. Front and rear walls 94, 96, respectively, enclose the housing. The front wall is shorter than the rear wall in accordance with the slope imparted to the side walls. Each side wall is provided with at least one notch 98, two notches 98 being shown on each side wall. The notches 98 are analogously positioned on each wall. Resting within the notches is a rod 100 which extends across the housing. The rod 100 has mounted thereon a spool of wire 102. It is, thus, seen that when a spool of wire is mounted on the rod, the wire is easily unreeled since the spool rotates about the rod.

Furthermore, it is apparent that a plurality of spools can be mounted on any one rod. Also, it should be noted and as clearly shown in FIG. 4, by inclining the side walls a plurality of rods can be accommodated in a "tiered" array. Thus, a plurality of spools can be employed at any one time free from any interference between one another.

In fabricating the present reeled wire holder any suitable materials, such as lightweight steel, alluminum, and the like can be used.

It is apparent from the preceding that there has been described a reeled wire holder which accommodates a plurality of coils of wire, whether spooled, coiled, cartoned or the like. Furthermore, the wire holder is easily transported on a vehicle while concommitantly disassembleable to be used on a job site. Thus, the device is completely portable. Coils of wire can be unreeled while the device is vehicle mounted or when the device is ground engaging thereby adding to the versatility of the device.

Having, thus, described the invention, what is claimed is:

1. A reeled wire holder, comprising:
a. a support stand,
b. means for detachably mounting the support stand to a bumper of a vehicle,
c. means for mounting a coil of wire onto the support stand, and
d. means for receiving a leg formed on the support stand such that upon receiving a leg the support stand can be detached from the bumper and stood upon the ground.

2. The reeled wire holder of claim 1 wherein the means for mounting a coil of wire comprises:
a. a central post,
b. a plurality of radially extending fins secured to the post,
c. a horizontally extending platform radiating from the central post, and wherein the coil of wire is mounted over the fins and seats on the platform.

3. The reeled wire holder of claim 2 wherein the platform comprises:
a. a plurality of arms rotatable between a horizontal and vertical position, each of the arms being disposed between adjacent fins, and
b. means for rotating the arms between a horizontal and vertical position.

4. The coiled reel wire holder of claim 1 wherein the means for mounting a coil of wire comprises:
a. a central post,
b. an open-topped housing seated atop the post, the housing including:
1. a pair of spaced apart parallel side walls, each side wall having a downward slope provided to its top edge,
2. a notch formed in the top edge of each side wall, and
c. a spooled wire receiving elongated rod which seats in the notches of the side wall.

5. The reeled wire holder of claim 1 wherein the support stand comprises:
a. a top wall having a plurality of apertures formed therealong,
b. a bottom wall spaced apart from the top wall and having a plurality of apertures formed therealong, one aperture of the top wall being in registry with one aperture of the bottom wall, and
c. a spacer element extending between the top and bottom walls and being secured thereto.

6. The reeled wire holder of claim 5 wherein the leg receiving means comprises:
leg receiving sockets disposed on the exterior surface of the support stand.

7. The reeled wire holder of claim 5 wherein the support stand further comprises:
a. an auxiliary support stand, and
b. means for hingedly connecting the auxiliary support stand to the support stand.

8. A reeled wire holder, comprising:
a. a support stand,
b. means for detachably mounting the support stand to a bumper of a vehicle,
c. means for mounting a coil of wire onto the support, comprising:
1. a central post,
2. a plurality of radially extending fins secured to the post,
3. a horizontally extending platform radiating from the central post, and
wherein the coil of wire is mounted over the fins and seats on the platform.

9. A reeled wire holder, comprising:
a. a support stand,
b. means for detachably mounting the support stand to a bumper of a vehicle,
c. means for mounting a coil of wire onto the support stand, comprising:
1. a central post,
2. an open-topped housing seated atop the post, the housing including:
a. a pair of spaced apart parallel side walls, each side wall having a downward slope provided to its top edge;
b. a notch formed in the top edge of each side wall, and
c. a spooled wire receiving elongated rod which seats in the notches of the side wall.

10. A reeled wire holder, comprising:
a. a support stand comprising:
1. a top wall having a plurality of apertures formed therealong,
2. a bottom wall spaced apart from the top wall and having a plurality of apertures formed therealong, one aperture being in registry with one aperture of the bottom wall, and
3. a spacer element extending between the top and bottom walls and being secured thereto,
b. means for detachably mounting the support stand to a bumper of a vehicle, and
c. means for mounting a coil of wire onto the support stand.

* * * * *